US012565729B2

(12) United States Patent
Buscarato et al.

(10) Patent No.: US 12,565,729 B2
(45) Date of Patent: Mar. 3, 2026

(54) LAUNDRY MACHINE AND CORRESPONDING LID

(71) Applicant: WHIRLPOOL CORPORATION, Benton Harbor, MI (US)

(72) Inventors: William Buscarato, Rio Claro (BR); Jessica Cardinali, Rio Claro (BR); Vanderlei Ferreira, Paulínia (BR); Ygor Riyuji Hamasaki Morais, Rio Claro (BR); Helton Figueira Rossi, Rio Claro (BR); Eduardo L. Violin, Rio Claro (BR)

(73) Assignee: Whirlpool Corporation, Benton Harbor, MI (US)

( * ) Notice: Subject to any disclaimer, the term of this patent is extended or adjusted under 35 U.S.C. 154(b) by 311 days.

(21) Appl. No.: 18/316,995

(22) Filed: May 12, 2023

(65) Prior Publication Data

US 2024/0376654 A1 Nov. 14, 2024

(51) Int. Cl.
*D06F 37/18* (2006.01)
*D06F 23/04* (2006.01)

(52) U.S. Cl.
CPC ..... *D06F 37/18* (2013.01); *D06F 23/04* (2013.01)

(58) Field of Classification Search
None
See application file for complete search history.

(56) References Cited

U.S. PATENT DOCUMENTS

| | | | | |
|---|---|---|---|---|
| 3,659,314 | A | 5/1972 | Ross | |
| 3,921,254 | A | 11/1975 | Foster, Jr. et al. | |
| 4,115,901 | A | 9/1978 | Schmidt | |
| 6,766,596 | B1 | 7/2004 | Bienick et al. | |
| 9,777,420 | B2 | 10/2017 | Mash et al. | |
| 9,909,248 | B2 | 3/2018 | Mora et al. | |
| 2009/0195130 | A1 | 8/2009 | Priego | |
| 2018/0016731 | A1* | 1/2018 | Mora | D06F 39/14 |
| 2021/0189634 | A1* | 6/2021 | Bixby | D06F 39/14 |

FOREIGN PATENT DOCUMENTS

| | | | |
|---|---|---|---|
| BR | 7803577 | A | 7/1979 |
| BR | PI9705359 | | 5/1997 |
| BR | PI1102372 | A2 | 5/2013 |
| BR | PI0909703 | A2 | 10/2015 |
| BR | 102016023266 | A2 | 5/2018 |

(Continued)

OTHER PUBLICATIONS

BR 102016023266 A2 translation, Washing Machine and Washing Machine Manufacturing Process, Neto (Year: 2018).*

*Primary Examiner* — Cristi J Tate-Sims
(74) *Attorney, Agent, or Firm* — Brooks Kushman P.C.

(57) ABSTRACT

A lid for a laundry machine is configured to open to provide access to a laundry treating chamber and close to conceal the laundry treating chamber. The lid includes a frame and a panel. The frame has a front beam, opposing side beams extending from the front beam, and an open back end. The front beam and opposing side beams collectively define a channel. The panel is disposed within the channel. The panel spans the opposing side beams. The panel extends from the front beam to the open back end. The panel has a rear edge extending between the opposing side beams along the open back end.

20 Claims, 7 Drawing Sheets

(56) References Cited

FOREIGN PATENT DOCUMENTS

| | | | |
|---|---|---|---|
| CA | 970117 | A | 7/1975 |
| EP | 2554735 | A1 | 2/2013 |
| GB | 2124483 | A | 2/1984 |
| GB | 2322073 | A | 8/1998 |
| WO | 2016099864 | A1 | 6/2016 |

* cited by examiner

LAUNDRY MACHINE AND CORRESPONDING LID

TECHNICAL FIELD

The present disclosure relates to washing or laundry machines.

BACKGROUND

Washing machines are configured to clean clothes, garments, or other clothing articles.

SUMMARY

A laundry machine includes a cabinet and a lid. The cabinet defines a chamber configured to receive laundry articles for treatment therein. The cabinet defines an opening to the chamber along a top of the cabinet. The lid is secured to the top of the cabinet. The lid is configured to transition between open and closed positions to provide access to and cover the opening, respectively. The lid includes a frame and a panel. The frame has a front beam, a first side beam, and a second side beam. The first and second side beams extend rearward from opposing ends of the front beam, respectively. The first and second side beams are spaced apart such that a back end of the frame terminates at rear ends of the first and second side beams and such that the back end of the frame is open between the first and second side beams. The panel is secured to the frame. The panel spans the first and second side beams. The panel extends from the front beam to the back end of the frame. The panel has a rear edge extending between the rear ends of the first and second side beams along the open back end of the frame.

A laundry machine lid is configured to transition between open and closed positions. The laundry machine lid includes a U-shaped frame and a panel. The U-shaped frame has a front end, opposing sides, and an open back end. The panel is secured to the U-shaped frame. The panel spans the opposing sides. The panel extends from the front end to the open back end. The panel has a rear edge extending between the opposing sides along the open back end.

A lid for a laundry machine is configured to open to provide access to a laundry treating chamber and close to conceal the laundry treating chamber. The lid includes a frame and a panel. The frame has a front beam, opposing side beams extending from the front beam, and an open back end. The front beam and opposing side beams collectively define a channel. The panel is disposed within the channel. The panel spans the opposing side beams. The panel extends from the front beam to the open back end. The panel has a rear edge extending between the opposing side beams along the open back end.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Illustrative washing machines in accordance with the present disclosure include a rotatable clothes mover or agitator and a rotatable basket or drum. Clothes movers generally oscillate, or rotate back and forth, in accordance with a stroke angle, to provide agitation to a laundry load during washing operations. Clothes movers and rotatable baskets generally spin together during spin cycle operations. To enable both of these functionalities, including oscillation by the clothes mover and joint spinning by the clothes mover and basket, a common drive system may be included. Such a drive system can include a drive mechanism or transmission for translating movement from an electric machine or motor into rotational movement of the basket and clothes mover by the use of a drive shaft that is operably coupled to a series of gears or gearing arrangement. Traditional drive mechanisms may include the use of a sun gear, a set of planetary gears, and an external ring gear. The planetary gears are often provided as spur gears. However, the gears may alternatively be helical gears in place of conventional spur gears in the drive mechanism. Traditional drive mechanisms, however, are not limited to planetary gear systems.

Figure 1:
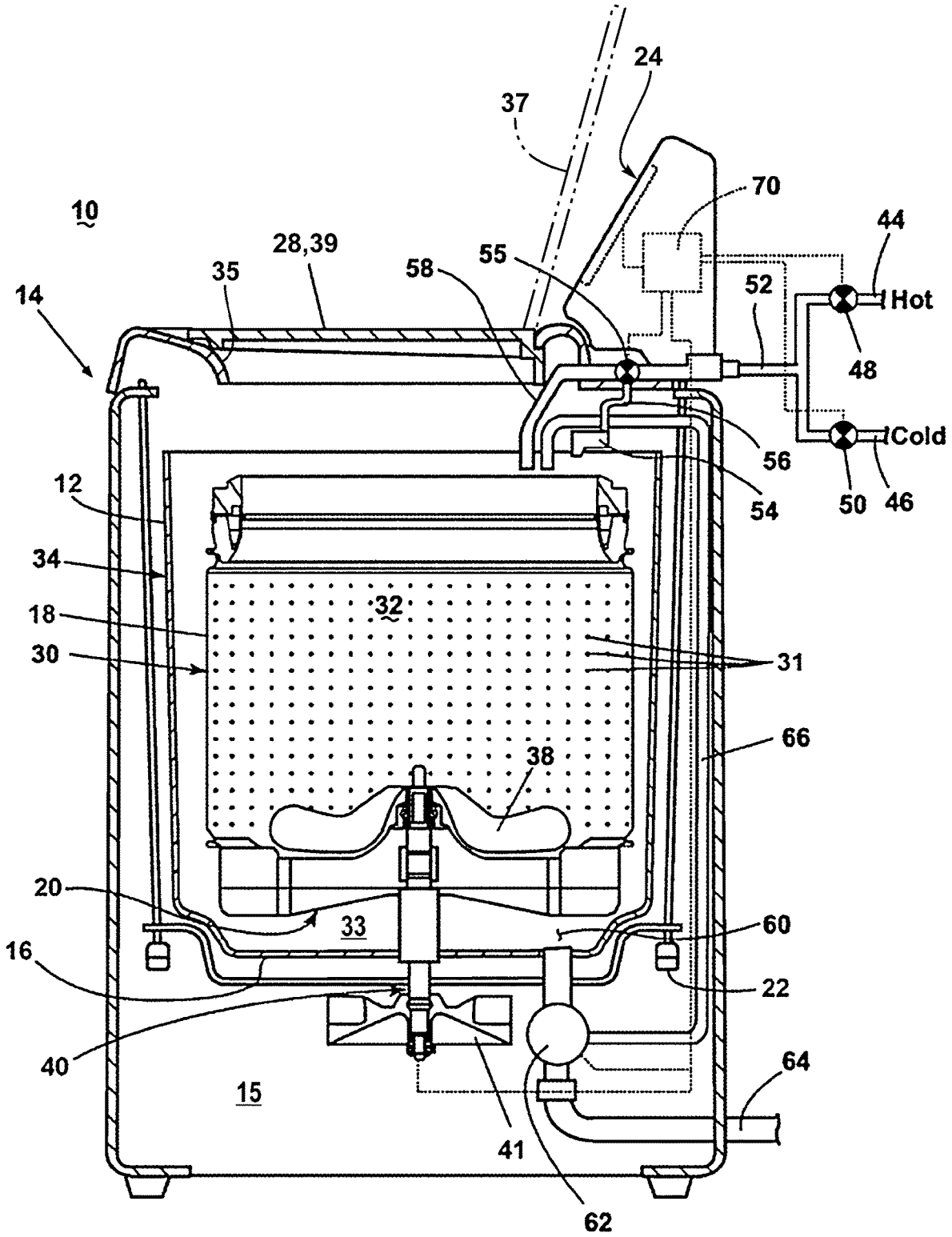
FIG. 1 illustrates a schematic cross-sectional view of a laundry treating appliance in the form of a laundry or washing machine according to the present disclosure.

FIG. 1 illustrates a schematic cross-sectional view of a laundry treating appliance shown in the form of a laundry or washing machine 10 according to one embodiment of the present disclosure. While the laundry treating appliance is illustrated as a vertical axis, top-fill washing machine, the embodiments of the present disclosure can have applicability in other fabric treating appliances, non-limiting examples of which include a combination washing machine and dryer, a refreshing/revitalizing machine, an extractor, or a non-aqueous washing apparatus.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a vertical axis washing machine.

The washing machine 10 may include a structural support system comprising a cabinet 14 that defines an interior space or internal cavity 15, within which a laundry holding system resides. The cabinet 14 may be a housing having a chassis and/or a frame defining an interior that receives components typically found in a conventional washing machine, such as electric machines (e.g., motors), pumps, fluid lines, controls, sensors, transducers, and the like. Such components will not be described further herein except as necessary for a complete understanding of the present disclosure.

The fabric holding system of the illustrated exemplary washing machine 10 may include a rotatable drum or basket 30 having an open top that can be disposed within the interior of the cabinet 14 (e.g., within internal cavity 15 defined by the cabinet 14) and may define second internal space, internal cavity, or treating chamber 32 for receiving laundry articles or items for treatment therein. Since the basket 30 is disposed within the internal cavity 15 defined by the cabinet 14, it may be said that the treating chamber 32 is also defined by or within the cabinet 14. The top of the cabinet 14 can include a selectively openable door or lid 28 to provide access into the laundry treating chamber 32 through the open top of the basket 30. More specifically, the cabinet 14 may define an opening 35 along the top of the cabinet that provides access to the treating chamber 32, and the lid 28 may be configured to transition between an open position 37 and a closed position 39 to provide access to and conceal (e.g., cover) the opening 35, respectively.

A washtub or tub 34 can also be positioned within the internal cavity 15 defined by the cabinet 14 and can define a third interior space or internal cavity 33 within which the basket 30 can be positioned. Since the tub 34 is disposed within the internal cavity 15 defined by the cabinet 14, it may be said that the third internal cavity 33 is also defined by or within the cabinet 14. The tub 34 can have a generally cylindrical side or tub peripheral wall 12 closed at its bottom end by a base 16 that can at least partially define a sump 60.

The basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation relative to the tub 34 and can include a plurality of perforations 31, such that liquid may flow between the tub 34 and the rotatable basket 30 through the perforations 31. While the illustrated washing machine 10 includes both the tub 34 and the basket 30, with the basket 30 defining the treating chamber 32, it is within the scope of the present disclosure for the laundry treating appliance to include only one receptacle, with the receptacle defining the laundry treatment chamber for receiving the load to be treated.

An agitator or clothes mover 38 may be disposed and rotatably mounted within the basket 30 to impart mechanical agitation to a load of laundry placed in the basket 30. The clothes mover 38 can be oscillated or rotated about its axis of rotation during a cycle of operation in order to produce load motion effective to wash the load contained within the treating chamber 32. Types of laundry movers include, but are not limited to, an agitator, a wobble plate, and a hybrid impeller/agitator.

The basket 30 and the clothes mover 38 may be driven by a drive system 40 that includes power sources, such as an electric machine or motor 41, and a transmission operably coupled with the basket 30 and clothes mover 38. The electric machine or motor 41 is configured to generate power to rotate the basket 30 and the clothes mover 38, and to oscillate the clothes mover 38. The transmission is configured to deliver power from a power source (e.g., motor 41) to the basket 30 and/or the clothes mover 38. The transmission may include a gearing arrangement or gear case. The transmission may also include additional components such as input and output shafts. The motor 41 may rotate the basket 30 at various speeds in either rotational direction about the vertical axis of rotation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch can be included in the drive system 40 and can selectively operably couple the motor 41 with either the basket 30 and/or the clothes mover 38.

A suspension system 22 can dynamically hold the tub 34 within the cabinet 14. The suspension system 22 can dissipate a determined degree of vibratory energy generated by the rotation of the basket 30 and/or the clothes mover 38 during a treating cycle of operation. Together, the tub 34, the basket 30, and any contents of the basket 30, such as liquid and laundry items, define a suspended mass for the suspension system 22.

A liquid supply system can provide liquid, such as water or a combination of water and one or more wash aids, such as detergent, into the treating chamber 32. The liquid supply system may include a water supply configured to supply hot or cold water. The water supply may include a hot water inlet 44 and a cold water inlet 46, a valve assembly, which can include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated as positioned on the exterior of the cabinet 14, it may be understood that these components may be internal to the housing.

As illustrated, a detergent dispenser 54 can be fluidly coupled with the conduit 52 through a diverter valve 55 and a first water conduit 56. The detergent dispenser 54 can include means for supplying or mixing detergent to or with water from the first water conduit 56 and can supply such treating liquid to the tub 34. It has been contemplated that water from the first water conduit 56 can also be supplied to the tub 34 through the detergent dispenser 54 without the addition of a detergent. A second water conduit, illustrated as a separate water inlet 58, can also be fluidly coupled with the conduit 52 through the diverter valve 55 such that water can be supplied directly to the treating chamber through the open top of the basket 30. Additionally, the liquid supply system can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system may be provided for recirculating liquid from the tub 34 into the treating chamber 32. More specifically, a sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

It is noted that the illustrated drive system, suspension system, liquid supply system, and recirculation and drain system are shown for exemplary purposes only and are not limited to the systems shown in the drawings and described above. For example, the liquid supply, recirculation, and pump systems can differ from the configuration shown in FIG. 1, such as by inclusion of other valves, conduits, treating chemistry dispensers, sensors (such as liquid level sensors and temperature sensors), and the like, to control the flow of liquid through the washing machine 10 and for the introduction of more than one type of treating chemistry. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 may further include a controller 70 coupled with various working components of the washing machine 10 to control the operation of the working components and to implement one or more treating cycles of operation. The control system can further include a user interface 24 that is operably coupled with the controller 70. The user interface 24 can include one or more knobs, dials, switches, displays, touch screens and the like for communicating with the user, such as to receive input and provide output. The user can enter different types of information including, without limitation, cycle selection and cycle parameters, such as cycle options.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
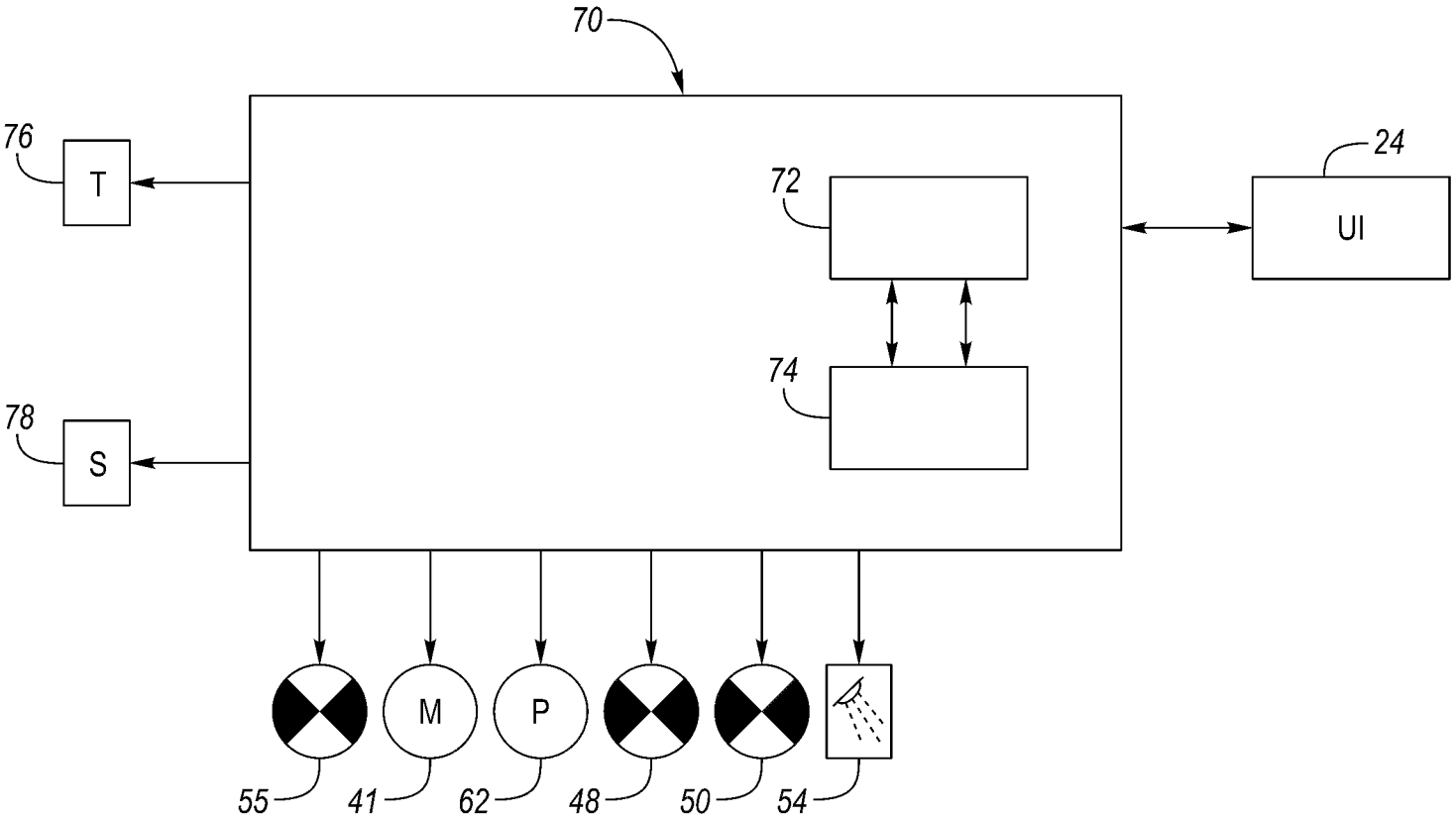
FIG. 2 illustrates a schematic representation of a controller for controlling the operation of one or more components of the laundry treating appliance.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. Examples, without limitation, of treating cycles of operation include: wash, heavy-duty wash, delicate wash, quick wash, pre-wash, refresh, rinse only, and timed wash, which can be selected at the user interface 24. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 may be operably coupled with one or more components of the washing machine 10 for communicating with and/or controlling the operation of the components to complete a cycle of operation. For example, the controller 70 may be coupled with the hot water valve 48, the cold water valve 50, diverter valve 55, and the detergent dispenser 54 for controlling the temperature and flow rate of treating liquid into the treating chamber 32; the pump 62 for controlling the amount of treating liquid in the treating chamber 32 or sump 60; drive system 40 including motor 41 for controlling the direction and speed of rotation of the basket 30 and/or the clothes mover 38; and the user interface 24 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include: a weight sensor, and a motor torque sensor.

While illustrated as one controller, the controller 70 may be part of a larger control system and may control or be controlled by various other controllers throughout the washing machine 10. It should therefore be understood that the controller 70 and one or more other controllers can collectively be referred to as a "controller" that controls various subcomponents or actuators of the washing machine 10 in response to signals from various subcomponents or sensors of the washing machine 10 to control various functions. The controller 70 may include the microprocessor or central processing unit (CPU) 74, which may be in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 70 in controlling the washing machine 10.

Control logic or functions performed by the controller 70 may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for case of illustration and description. The control logic may be implemented primarily in software executed by a microprocessor-based controller, such as controller 70. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the washing machine 10 or its subsystems. The computer-readable storage devices or media may include one or more of a number of known physical devices which utilize electric, magnetic, and/or optical storage to keep executable instructions and associated calibration information, operating variables, and the like.

Figure 3:
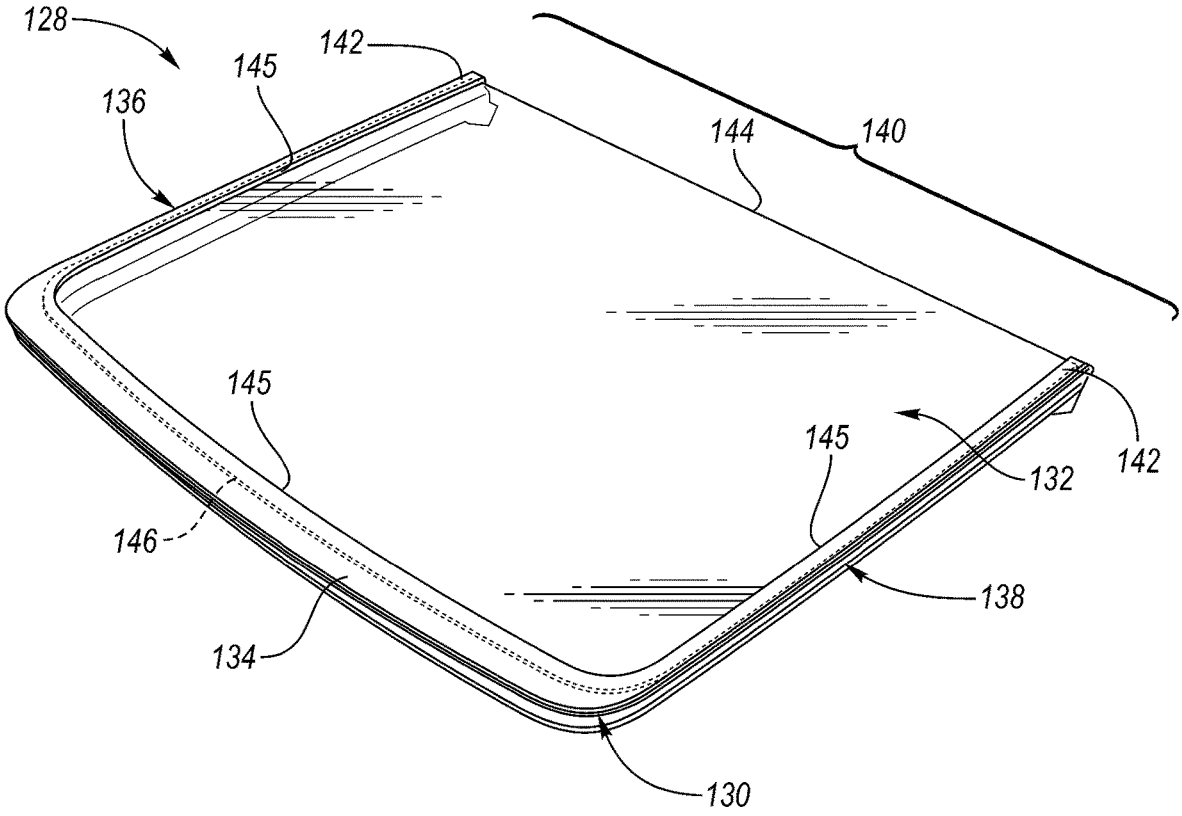
FIG. 3 is an isometric top view of a first embodiment of a lid for the laundry treating appliance.
Figure 4:
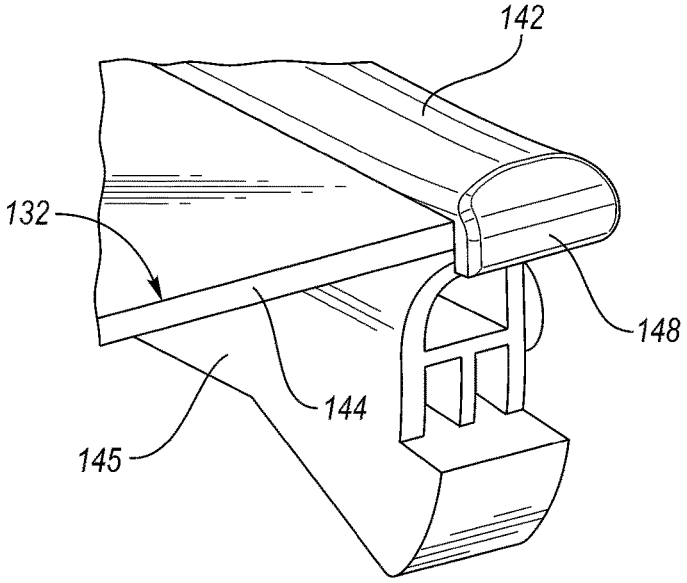
FIG. 4 is an isometric rear view of a portion of a back end the first embodiment of the lid for the laundry treating appliance.
Figure 5:
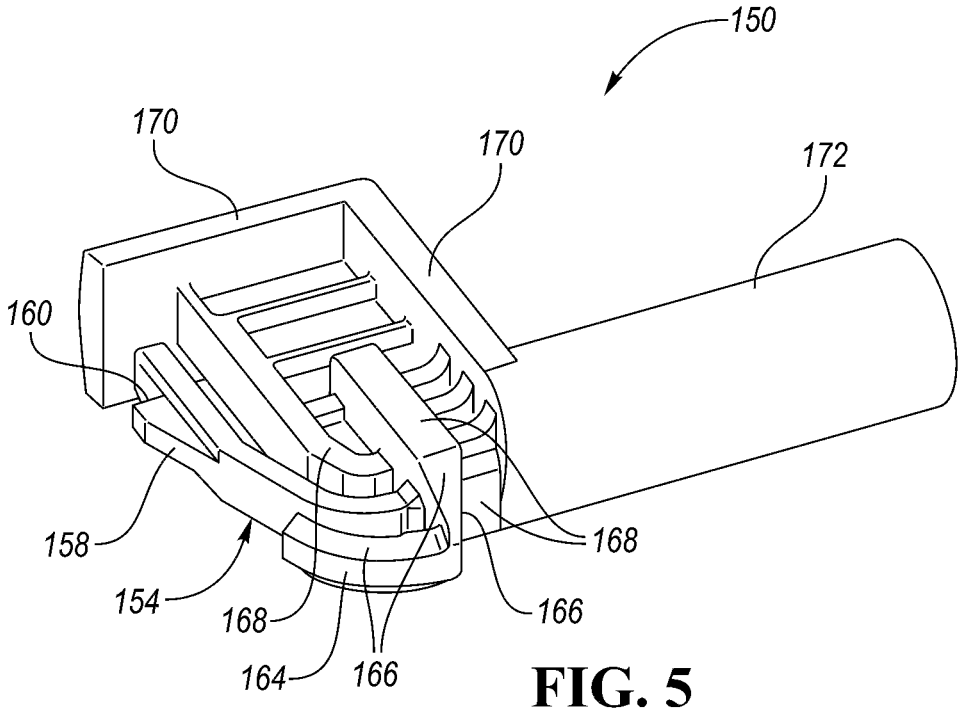
FIG. 5 is an isometric top view of a hinge pin for the lid.
Figure 6:
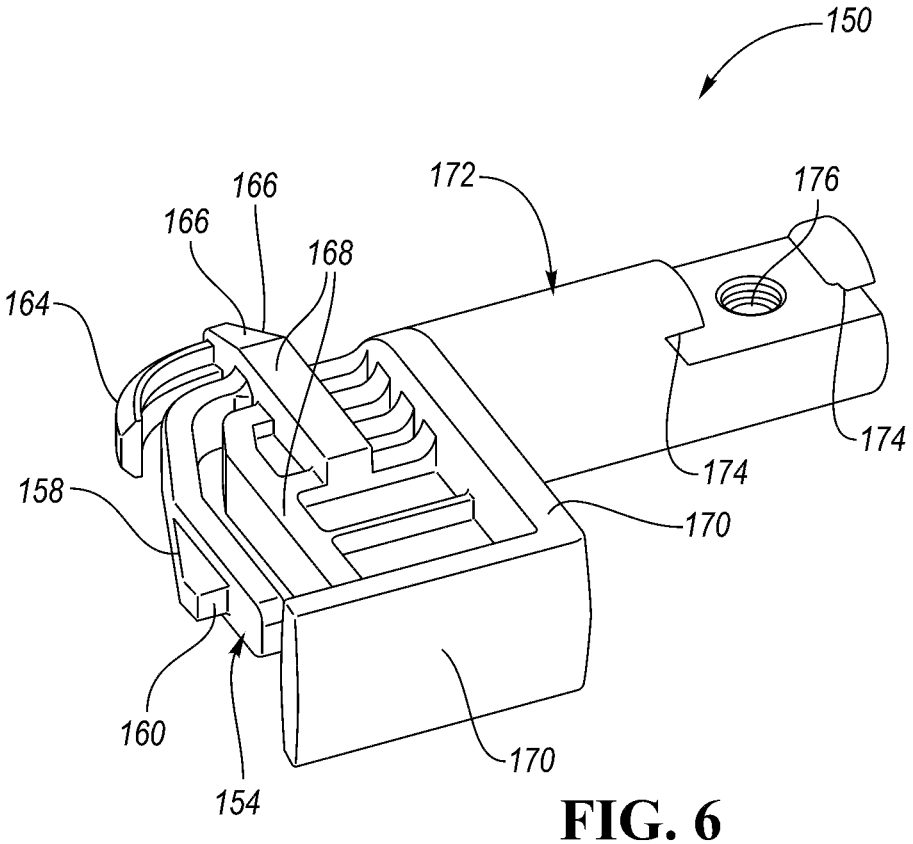
FIG. 6 is an isometric bottom view of the hinge pin for the lid.
Figure 7:
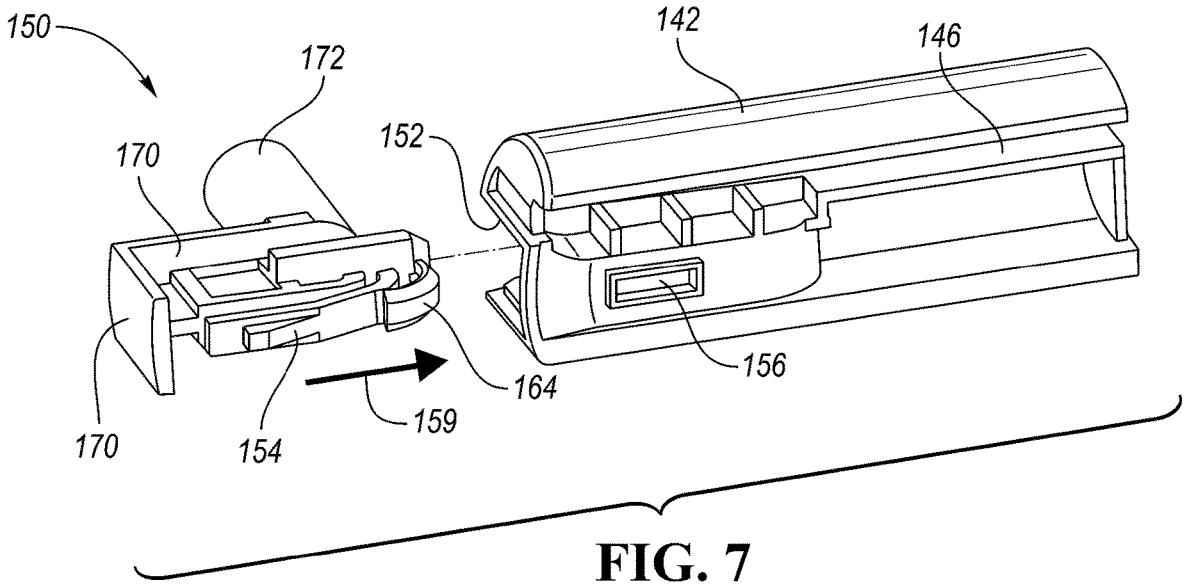
FIG. 7 is an isometric view illustrating installation of the hinge pin onto the lid.
Figure 8:
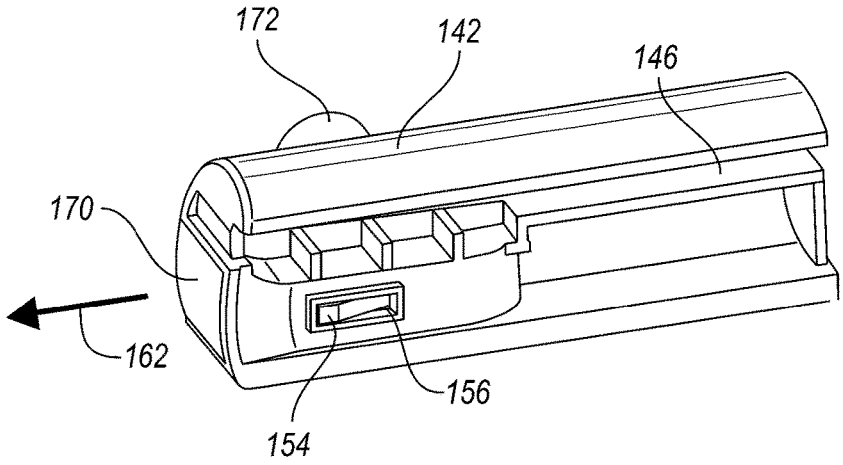
FIG. 8 is an isometric view illustrating removal of the hinge pin from the lid.

Referring to FIGS. 3 and 4, a first embodiment of a door or lid 128 for a laundry treating appliance (e.g., washing machine 10) is illustrated. The lid 128 may include all of the characteristics, functionality, subcomponents, etc. of lid 28 depicted in FIG. 1 unless otherwise stated herein. The lid 128 includes a frame 130 and a panel 132. The panel 132 may be made from glass so that a user may view the items disposed within the treating chamber 32. The frame 130 may be made from a hard plastic or metallic material (e.g., aluminum or steel) to provide structural support for the panel 132. The frame 130 may be U-shaped. The frame 130 may include a front beam 134, a first side beam 136, and a second side beam 138. The first side beam 136 and the second side beam 138 may be referred to as opposing side beams. The front beam 134 may form a front end of the frame 130. The first side beam 136 and the second side beam 138 may form opposing sides of the frame 130.

The first side beam 136 and the second side beam 138 extend rearward from opposing ends of the front beam 134, respectively. The first side beam 136 and the second side beam 138 are spaced apart (i) such that a back end 140 of the frame 130 terminates at rear ends 142 of the first and second side beams 136, 138 and (ii) such that the back end 140 of the frame 130 is open between the first and second side beams 136, 138. The back end 140 of the frame 130 may be referred to as the open back end. The first side beam 136 and the second side beam 138 may be substantially parallel to each other. Substantially parallel may refer to any incremental angle that ranges between exactly parallel and 15° from exactly parallel.

The panel 132 is secured to the frame 130. The panel 132 spans a distance between the first side beam 136 and the second side beam 138. The panel 132 extends from the front beam 134 to the back end 140 of the frame 130. The panel 132 has a rear edge 144 that extends between the rear ends 142 of the first and second side beams 136, 138 along the open back end 140 of the frame 130. Internal edges 145 of the front beam 134, the first side beam 136, and the second side beam 138 may collectively define a channel 146. The channel 146 may be a C-shaped channel and may be referred to as a C-channel. The channel 146 receives and supports the panel 132. Stated in other terms, the panel 132 is disposed within the channel 146.

The frame 130 may further comprise clips or snaps 148 that are disposed along the rear ends 142 of the first and second side beams 136, 138. The snaps 148 engage the rear edge 144 of the panel 132 to secure the panel 132 within the channel 146. The snaps 148 are configured to (i) flex to provide access to the channel 146 along the back end 140 of the frame 130 during installation of the panel 132 into the channel 146 and (ii) snap back to cover the channel 146 along the back end 140 of the frame 130 upon completing installation of the panel 132 into the channel 146. More specifically, with reference to the orientation of the snap 148 in FIG. 4, the snaps 148 may be configured to flex upward to provide access to the channel 146 and snap back in a downward direction to cover the channel 146.

Referring to FIGS. 5-8, a hinge pin 150 for the lid 128 is illustrated. The lid 128 may include two of the hinges pins 150. The hinge pins 150 may be secured to the frame 130. More specifically, one of the hinge pins 150 may be secured to the rear end 142 of the first beam 136 while the other of the hinge pins 150 may be secured to the rear end 142 of second side beam 138. The two hinge pins 150 may be mirror images of each other. Therefore, it should be understood that one of the two hinge pins 150 may be the mirror image of the hinge pin 150 that is depicted in FIGS. 5-8. The two hinge pins 150 may be aligned along a common axis but may extend outward on the axis in opposing directions (e.g., in directions that extend at 180° relative to each other) once the hinge pins 150 are secured to the lid 128. The hinge pins 150 may pivotably or rotatably engage orifices defined by the cabinet 14 or bushings that are disposed on the cabinet 14. The lid 128 may be rigidly fixed to the hinge pins 150 such that rotation of the hinge pins 150 within the orifices defined by the cabinet 14 or bushings allows the lid to transition between open and closed positions (e.g., open position 37 and closed position 39).

The first and second side beams 136, 138 may each define notches 152 along the rear ends 142 of the first and second side beams 136, 138. The notches 152 may be defined along the rear ends 142 and lateral exterior surfaces or edges of the first and second side beams 136, 138 (i.e., the notches 152 may face laterally outward and may be defined on an opposite side of the first and second side beams 136, 138 relative to the channel 146). The hinge pins 150 may include clips or snaps 154 extending therefrom. The snaps 154 may engage the first and second side beams 136, 138 within the notches 152 to secure the hinge pins 150 to the first and second side beams 136, 138. The snaps 154 may extend through slots 156 defined by the first and second side beams 136, 138 to secure the hinge pins 150 to the first and second side beams 136, 138.

The snaps 154 may include ramped surfaces 158 that allow the snaps 154 to flex inward during installation or assembly of the hinge pins 150 onto the first and second side beams 136, 138 along direction 159. The snaps 154 also include stopping surfaces 160 that engage the first and second side beams 136, 138 within the slots 156 to prevent the hinge pins 150 from disengaging or being removed from the first and second side beams 136, 138. The hinge pins 150 may be removed, uninstalled, or disassembled from the first and second side beams 136, 138 along direction 162 if the snaps 154 are engaged and depressed outward (e.g., in a direction outward relative to the lid 128 as a whole) through the slots 156.

The hinge pins 150 may include shields or snap protectors 164 that are disposed in front of the snaps 154 along the direction of installation (e.g., direction 159). The snap protectors 164 may protect the snaps 154 during installation. The hinge pins 150 may include alignment surfaces or features (e.g., chamfers 166) that engage the first and second side beams 136, 138 within the notches 152 to guide the hinge pins 150 toward a desired position during installation. The hinge pins 150 may also include features (e.g., the snaps 154 and various surfaces 168) that engage the first and second side beams 136, 138 within the notches 152 to restrict relative motion between the hinge pins 150 and the lid 128 (or more specifically to restrict relative motion between the hinge pins 150 and the frame 130). Such features that restrict relative motion between the hinge pins 150 and the lid 128 may be referred to as degree of freedom lockers.

The hinge pins 150 may also include cover plates 170 that conceal the notches 152 once the hinge pins 150 are installed onto the first and second side beams 136, 138. Pin portions 172 of the hinge pins 150 may more specifically pivotably or rotatably engage the orifices defined by the cabinet 14 or bushings that are disposed on the cabinet 14. The pin portions 172 may define slots 174 that are each configured to receive a lever or arm that is connect to an actuator (e.g., an electric motor, electric solenoid, pneumatic cylinder, hydraulic cylinder, etc.) so that the lid 128 may be automatically opened and closed (e.g., transitioned between the open position 37 and the closed position 39). Orifices 176 that are configured receive fasteners may be defined adjacent to the slots 174. The orifices 176 may intersect the slots 174. Fasteners may engage the levers or arms that are connect to an actuator and may engage the orifices 176 to secure the levers or arms to the hinge pins 150 (or more specifically to secure the levers or arms to the pin portions 172). The pin portions 172 may also be referred to as degree of freedom lockers since engagement between the pin portions 172 and the corresponding orifices or bushings in which the pins portions 172 rotate limit movement of the pin portions 172 to rotation relative to a single axis.

Figure 9:
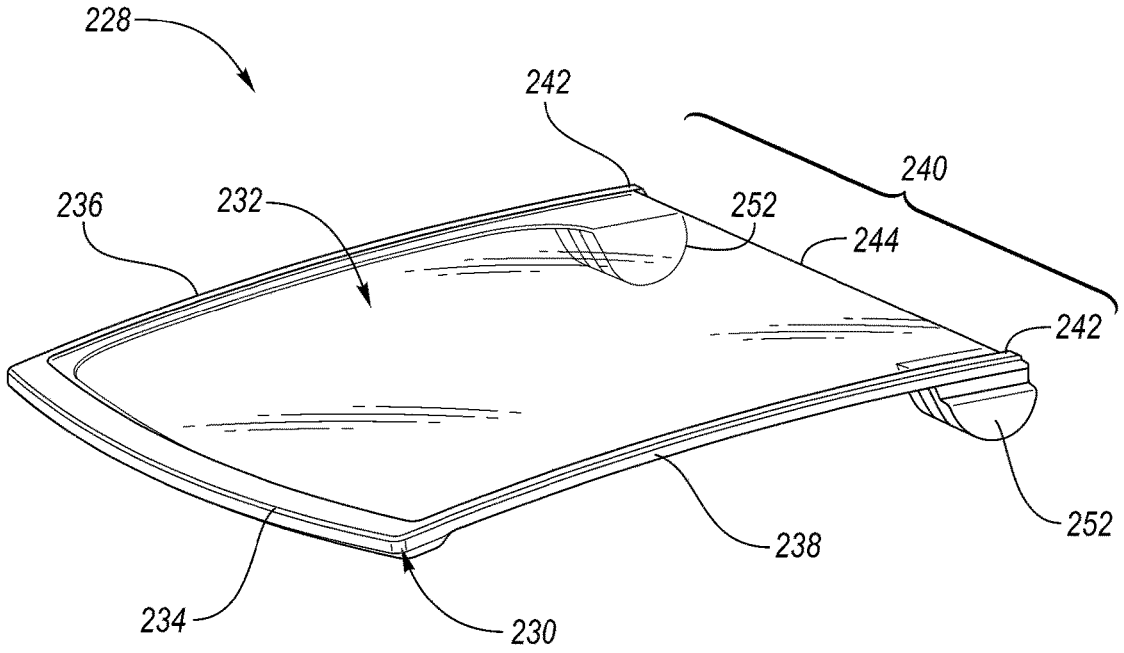
FIG. 9 is an isometric top view of a second embodiment of the lid for the laundry treating appliance.
Figure 10:
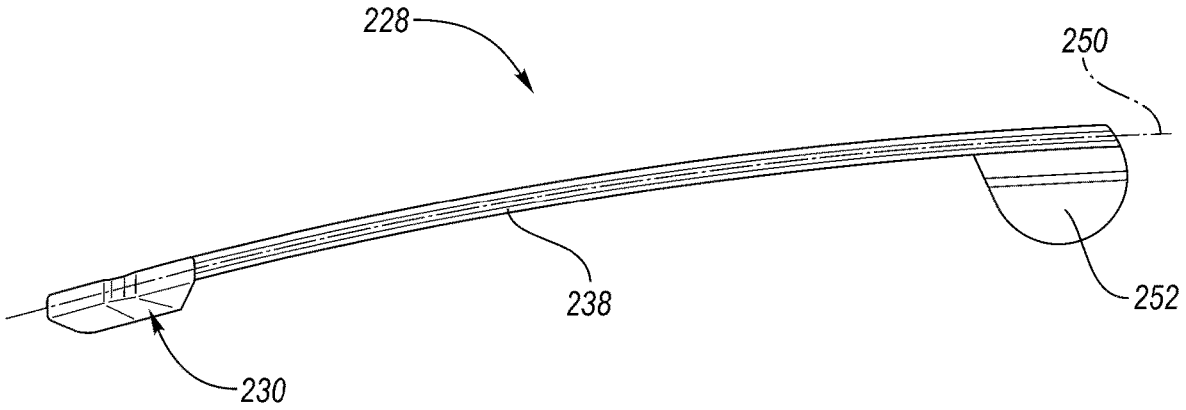
FIG. 10 is a side view of the second embodiment of the lid for the laundry treating appliance.

Referring to FIGS. 9 and 10, a second embodiment of a door or lid 228 for a laundry treating appliance (e.g., washing machine 10) is illustrated. The lid 228 may include all of the characteristics, functionality, subcomponents, etc. of lid 128 depicted in FIGS. 3 and 4 unless otherwise stated herein. The lid 228 may also include all of the characteristics, functionality, subcomponents, etc. of lid 28 depicted in FIG. 1 unless otherwise stated herein. The lid 228 includes a frame 230 and a panel 232. The panel 232 may be made from glass so that a user may view the items disposed within the treating chamber 32. The frame 230 may be made from a hard plastic or metallic material (e.g., aluminum or steel) to provide structural support for the panel 232. The frame 230 may be U-shaped. The frame 230 may include a front beam 234, a first side beam 236, and a second side beam 238. The first side beam 236 and the second side beam 238 may be referred to as opposing side beams. The front beam 234 may form a front end of the frame 230. The first side beam 236 and the second side beam 238 may form opposing sides of the frame 230.

The first side beam 236 and the second side beam 238 extend rearward from opposing ends of the front beam 234, respectively. The first side beam 236 and the second side beam 238 are spaced apart (i) such that a back end 240 of the frame 230 terminates at rear ends 242 of the first and second side beams 236, 238 and (ii) such that the back end 240 of the frame 230 is open between the first and second side beams 236, 238. The back end 240 of the frame 230 may be referred to as the open back end. The first side beam 236 and the second side beam 238 may be substantially parallel to each other. Substantially parallel may refer to any incremental angle that ranges between exactly parallel and 15° from exactly parallel.

The panel 232 is secured to the frame 230. The panel 232 spans a distance between the first side beam 236 and the second side beam 238. The panel 232 extends from the front beam 234 to the back end 240 of the frame 230. The panel 232 has a rear edge 244 that extends between the rear ends 242 of the first and second side beams 236, 238 along the open back end 240 of the frame 230. Internal edges 246 of the front beam 234, the first side beam 236, and the second side beam 238 may collectively define a channel. The channel may be a C-shaped channel and may be referred to as a C-channel. The channel receives and supports the panel 232. Stated in other terms, the panel 232 is disposed within the channel. The frame 230 may further comprise snaps that are disposed along the rear ends 242 of the first and second side beams 236, 238. The snaps may operate in the same manner as snaps 148 described above.

The first side beam 236, the second side beam 238, and the panel 232 may extend between the front beam 234 and the back end 240 of the frame 230 along an arc 250. Rounded protrusions 252 may extend downward from the rear ends 242 of the first and second side beams 236, 238. The rounded protrusions 252 pivotably engage the cabinet 14 (e.g., may be disposed in rounded orifices or notches defined by the cabinet) such that the lid 228 is configured to transition between open and closed positions (open position 37 and the closed position 39) via pivoting about the rounded protrusions 252. Alternatively, the rounded protrusions 252 may be eliminated and the hinge pins 150 may be secured to the first and second side beams 236, 238 in the same manner as described above with respect to first and second side beams 136, 138.

Figure 11:
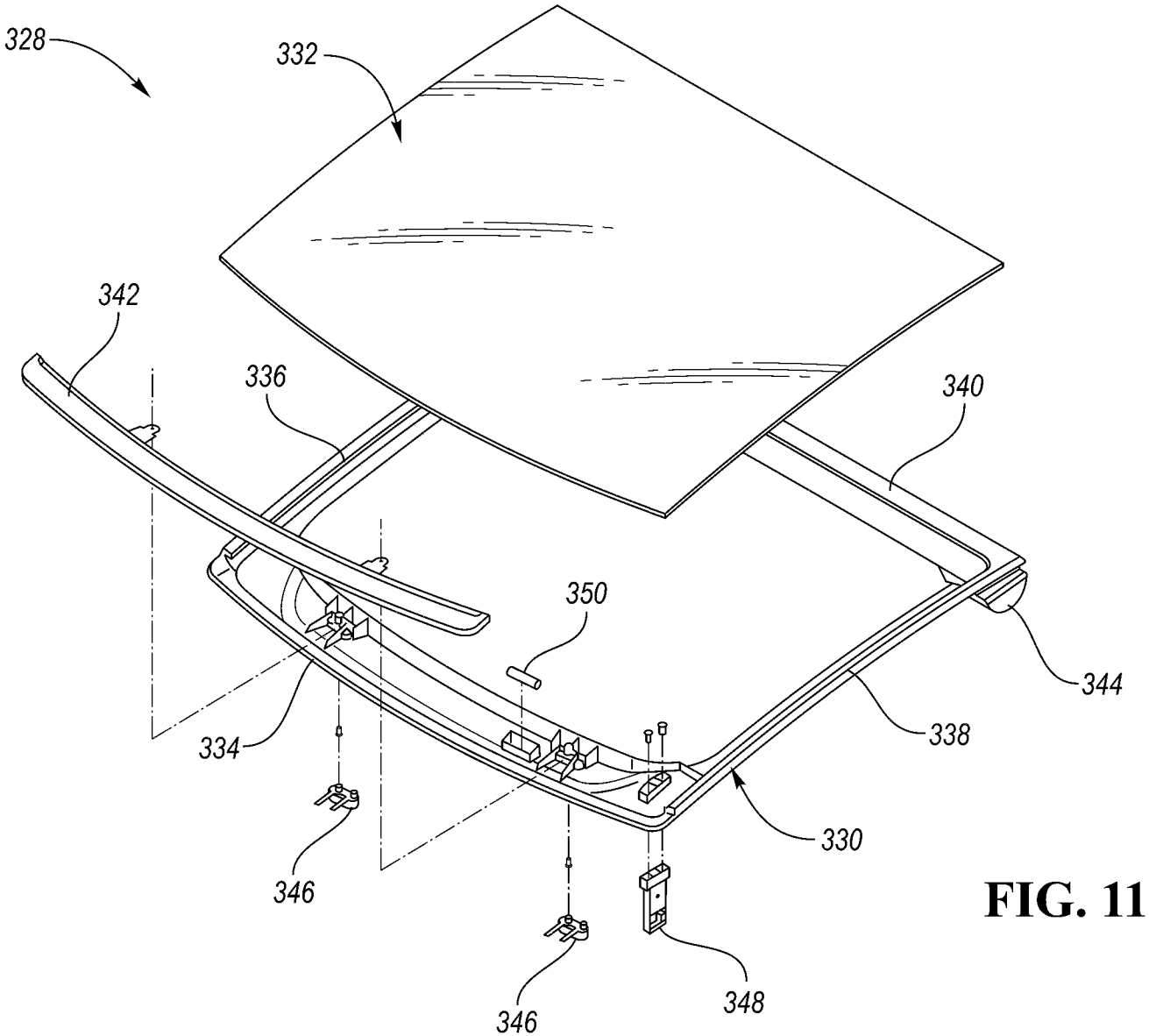
FIG. 11 is an isometric exploded top view of a third embodiment of the lid for the laundry treating appliance.

Referring to FIG. 11, a third embodiment of a door or lid 328 for a laundry treating appliance (e.g., washing machine 10) is illustrated. The lid 328 may include all of the characteristics, functionality, subcomponents, etc. of lid 28 depicted in FIG. 1 unless otherwise stated herein. The lid 328 includes a frame 330 and a panel 332. The panel 332 may be made from glass so that a user may view the items disposed within the treating chamber 32. The frame 330 may be made from a hard plastic or metallic material (e.g., aluminum or steel) to provide structural support for the panel 332. The frame 330 may include a front beam 334, a first side beam 336, a second side beam 338, and rear beam 340. The first side beam 336 and the second side beam 338 may be referred to as opposing side beams. The front beam 334 may form a front end of the frame 330. The rear beam 340 may form a rear end of the frame 330. The first side beam 336 and the second side beam 338 may form opposing sides of the frame 330.

The panel 332 is secured to the frame 330. The panel 332 spans a distance between the first side beam 336 and the second side beam 338. The panel 332 also spans a distance from the front beam 334 to the rear beam 340. A trim component 342 engages a top of the panel 332 and is fastened to the frame 330 to secure the panel 332 to a top of the frame 330. Rounded protrusions 344 may extend downward from the rear ends the first and second side beams 336, 338. The rounded protrusions 344 pivotably engage the cabinet 14 (e.g., may be disposed in rounded orifices or notches defined by the cabinet) such that the lid 328 is configured to transition between open and closed positions (open position 37 and the closed position 39) via pivoting about the rounded protrusions 344. Resting pads 346 may be disposed along the bottom of the front beam 334. The resting pads 346 engage a top surface of the cabinet 14 and may be made from a soft material (e.g., soft plastic or rubber). A striker 348 may also extend downward from the bottom of the front beam 334. The striker 348 may be configured to engage a latch on the cabinet 14 to lock the lid 328 in the closed position 39. A magnet 350 may be secured to the front beam 334 in addition to or in lieu of the striker 348. The magnet 350 may be configured to engage the cabinet 14 to secure the lid 328 in the closed position 39.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A laundry machine comprising:

a cabinet defining (i) a chamber configured to receive laundry articles for treatment therein and (ii) an opening to the chamber along a top of the cabinet, and a lid (i) secured to the top of the cabinet and (ii) configured to transition between open and closed positions to provide access to and cover the opening, respectively, wherein the lid includes, a frame having (i) a front beam, (ii) a first side beam, and (iii) a second side beam, wherein the first and second side beams (a) extend rearward from opposing ends of the front beam, respectively, and (b) are spaced apart such that a back end of the frame terminates at rear ends of the first and second side beams and is open between the first and second side beams, and wherein internal edges of the front beam, the first side beam, and the second side beam collectively define a C-channel, a panel (i) secured to the frame, (ii) spanning the first and second side beams, (iii) extending from the front beam to the back end of the frame, and (iv) having a rear edge extending between the rear ends of the first and second side beams along the open back end of the frame, wherein the panel is received and supported within the C-channel, and snaps disposed along the rear ends of the first and second side beams, wherein the snaps engage the rear edge of the panel to secure the panel within the C-channel.

2. The laundry machine of claim 1, wherein the snaps are configured to (i) flex to provide access to the C-channel along the back end of the frame during installation of the panel into the C-channel and (i) snap back to cover the C-channel along the back end of the frame upon completing installation of the panel into the C-channel.

3. The laundry machine of claim 1, wherein the first side beam, the second side beam, and the panel extend between the front beam and the back end of the frame along an arc.

4. The laundry machine of claim 1 further comprising rounded protrusions extending downward from the rear ends of the first and second side beams, wherein the rounded protrusions pivotably engage the cabinet such that the lid is configured to transition between the open and closed positions via pivoting about the rounded protrusions.

5. The laundry machine of claim 1 further comprising first and second hinge pins (i) extending from the lid and (ii) pivotably engaging the cabinet such that the lid is configured to transition between the open and closed positions via the first and second hinge pins, wherein (a) the first and second side beams define first and second notches along the rear ends of the first and second side beams, respectively, (b) the first and second hinge pins have first and second secondary snaps extending therefrom, respectively, and (c) the first and second secondary snaps engage the first and second side beams within the first and second notches, respectively, to secure the first and second hinge pins to the first and second side beams, respectively.

6. A laundry machine lid configured to transition between open and closed positions comprising:

a U-shaped frame having (i) a front end, (ii) opposing sides, and (iii) an open back end, wherein an internal edge of the U-shaped frame defines a C-channel;

a panel (i) secured to the U-shaped frame, (it) spanning the opposing sides, (in) extending from the front end to the open back end, and (iv) having a rear edge extending between the opposing sides along the open back end, wherein the panel is received and supported within the C-channel, and snaps (i) disposed along ends of the opposing sides of the U-shaped frame opposite of the front end of the U-shaped frame and (ii) operable to engage the rear edge of the panel to secure the panel within the C-channel.

7. The lid of claim 6, wherein the snaps are configured to (i) flex to provide access to the C-channel along the ends of the opposing sides of the U-shaped frame during installation of the panel into the C-channel and (it) snap back to cover the C-channel along the ends of the opposing sides of the U-shaped frame upon completing installation of the panel into the C-channel.

8. The lid of claim 6, wherein the opposing sides of the U-shaped frame and the panel extend between the front end of the U-shaped frame and the open back end of the U-shaped frame along an arc.

9. The lid of claim 6 further comprising rounded protrusions extending downward from ends of the opposing sides of the U-shaped frame opposite of the front end of the U-shaped frame, wherein the lid is configured to transition between the open and closed positions via pivoting about the rounded protrusions.

10. The lid of claim 6 further comprising first and second hinge pins extending from the lid, wherein (i) the lid is configured to transition between the open and closed positions via pivoting about the first and second hinge pins, (ii) the opposing sides of the U-shaped frame define notches along ends of the opposing sides of the U-shaped frame opposite of the front end of the U-shaped frame, (iii) the first and second binge pins have first and second secondary snaps extending therefrom, respectively, and (iv) the first and second secondary snaps engage the opposing sides of the U-shaped frame within the notches to secure the first and second hinge pins to the opposing sides of the U-shaped frame.

11. A lid for a laundry machine configured to (i) open to provide access to a laundry treating chamber and (ii) close to conceal the laundry treating chamber, the lid comprising:

a frame having (i) a front beam, (ii) opposing side beams extending from the front beam, and (in) an open back end, wherein the front beam and opposing side beams collectively define a channel;

a panel (i) disposed within the channel, (ii) spanning the opposing side beams, (ii) extending from the front beam to the open back end, and (iv) having a rear edge extending between the opposing side beams along the open back end; and snaps (i) disposed along ends of the opposing side beams opposite of the front beam and (i) operable to engage the rear edge of the panel to secure the panel within the channel.

12. The lid of claim 11, wherein the snaps are configured to (i) flex to provide access to the channel along the ends of the opposing side beams during installation of the panel into the channel and (ii) snap back to cover the channel along the ends of the opposing side beams upon completing installation of the panel into the channel.

13. The lid of claim 11, wherein the opposing side beams and the panel extend between the front beam and the open back end of the frame along an arc.

14. The lid of claim 11 further comprising first and second hinge pins extending from the lid, wherein (i) the lid is configured to transition between open and closed positions via pivoting about the first and second hinge pins, (ii) the opposing side beams define notches along ends of the opposing side beams, opposite of the front beam, (iii) the first and second hinge pins have first and second secondary snaps extending therefrom, and (iv) the first and second secondary snaps engage the opposing side beams within the notches to secure the first and second hinge pins to the opposing side beams.

15. The laundry machine of claim 5, wherein the first and second side beams define first and second slots, and wherein at least a portion of the first and second secondary snaps extend through the first and second slots, respectively; to secure the first and second hinge pins to the first and second side beams, respectively.

16. The laundry machine of claim 5, wherein the first and second snaps further comprise ramped surfaces configured to engage the first and second side beams to facilitate displacing snaps during assembly of the first and second hinge pins onto the first and second side beams, respectively.

17. The lid of claim 10, wherein the opposing sides of the U-shaped frame define slots, and wherein at least a portion of the first and second secondary snaps extend through the slots to secure the first and second hinge pins to the opposing sides of the U-shaped frame.

18. The lid of claim 10, wherein the first and second snaps further comprise ramped surfaces configured to engage the opposing sides of the U-shaped frame to facilitate displacing snaps during assembly of the first and second hinge pins onto the opposing sides of the U-shaped frame.

19. The lid of claim 14, wherein the opposing side beams define slots, and wherein at least a portion of the first and second secondary snaps extend through the slots to secure the first and second hinge pins to the opposing side beams.

20. The lid of claim 14, wherein the first and second snaps further comprise ramped surfaces configured to engage the opposing side beams to facilitate displacing snaps during assembly of the first and second hinge pins onto the opposing side beams.

* * * * *